US006257150B1

(12) United States Patent
Burke

(10) Patent No.: US 6,257,150 B1
(45) Date of Patent: Jul. 10, 2001

(54) RAPID DISCHARGE RAILCAR DOOR

(75) Inventor: Michael K. Burke, Wheaton, IL (US)

(73) Assignee: Zeftek, Inc., Montgomery, IL (US)

( * ) Notice: Subject to any disclaimer, the term of this patent is extended or adjusted under 35 U.S.C. 154(b) by 0 days.

(21) Appl. No.: 09/578,376

(22) Filed: May 25, 2000

Related U.S. Application Data

(60) Provisional application No. 60/136,453, filed on May 28, 1999.

(51) Int. Cl.[7] ..... B61D 7/02

(52) U.S. Cl. ..... 105/247; 105/238.1; 105/240; 105/250; 105/255; 105/280; 105/310; 49/501; 239/650

(58) Field of Search ..... 105/238.1, 240, 105/247, 250, 255, 280, 310, 406.2; 49/501; 239/650, 676

(56) References Cited

U.S. PATENT DOCUMENTS 3,658,596 * 4/1972 Osborne ..... 136/89
4,155,200 * 5/1979 Emanuel ..... 49/501
4,278,382 * 7/1981 Knippel ..... 414/388
5,426,894 * 6/1995 Headrick ..... 49/468

FOREIGN PATENT DOCUMENTS

WO99/15358 A1 * 4/1999 (GB) ..... B60P/1/28
WO9915358 * 4/1999 (GB) ..... B60P/1/28

* cited by examiner

*Primary Examiner*—S. Joseph Morano
*Assistant Examiner*—Frantz F. Jules
(74) *Attorney, Agent, or Firm*—Lloyd L. Zickert

(57) ABSTRACT

A rapid discharge railcar door consisted of a plastic main body reinforced by an aluminum frame, and which provides sufficient strength against load-bearing forces and withstands changes in temperature. The main body of the door is made from a polymer in a reaction injection molding process. The door reduces the overall weight of the railway car, thus allowing more coal to be shipped per car.

24 Claims, 7 Drawing Sheets

RAPID DISCHARGE RAILCAR DOOR

This application claim benefit to Provisional application 60/136,483 filed May 28, 1999.

DESCRIPTION

This invention relates in general to a new and improved rapid discharge railcar door for railway coal cars, and more particularly to a rapid discharge coal car door made of a polymer formed in a reaction injection molding (RIM) process over an aluminum frame that significantly lowers the weight of the door to allow for more coal to be loaded in the railway car, and which provides sufficient strength and resistance to changes in temperature.

BACKGROUND OF THE INVENTION

Coal continues to be a prevalent source of energy, particularly for electric generating stations. Millions of tons of coal are transported by railway cars each year within the United States between a coal mine and a user facility. In order to maintain the condition of the railways and to insure safety, regulations are imposed to limit the total weight of each railway car. Currently, the total weight allowed for each railway car, including the weight of the car itself, is 286,000 pounds. As the coal companies obviously desire to ship the most amount of coal per railway car or ship a certain amount of coal with the least amount of railway cars, there has been a continuous effort to lower the weight of the railway cars while still maintaining the railway cars' structural integrity. However, one limiting factor in improving railway cars is the fact that as the coal is transported across the country, it may pass through various states and be subjected to various weather conditions. For example, when coal passes through sub-zero temperatures, it will freeze, and thus require the coal to be subjected to a thawing process. Thus, any components in the coal cars must be able to withstand the various stresses imparted upon them.

Heretofore, it has been known to use an aluminum door with a steel frame for rapid discharge coal car doors. The use of an all metal door, especially with a steel frame, results in a door having a weight of almost 190 pounds. Heretofore used all-steel doors are even heavier. Most coal cars are hopper cars with multiple outlets in the bottom selectively opened and closed by discharge doors. A commonly found hopper car has sixteen discharge doors working together in pairs to cover eight discharge outlets. The total weight of sixteen all-metal doors is over 3000 pounds, or about one percent of the total allotted weight per railway car.

Others have considered using certain plastics, such as polyurethane, as a substitute for the aluminum doors. However, such plastic doors generally would not withstand the heating the doors must be subjected to during the thawing process. Further, it is unclear whether doors made of regular polyurethane would have sufficient strength to adequately support the coal load and perform adequately as a rapid discharge coal car door.

SUMMARY OF THE INVENTION

The present invention is in a plastic door molded on an aluminum frame which overcomes the weight and temperature change problems of metal and other plastic doors. The door of the present invention is made from a polymer formed in a reaction injection molding (RIM) process. Polymers formed using a RIM process provide a light-weight and strong product that can withstand various stresses associated with coal loads and the changes in temperature and weather. It should also be appreciated that the door of the present invention may be used on any bottom dumping car carrying granular material, such as plastic pellets and the like.

Heretofore used aluminum doors with steel frames weighed about 190 pounds, as above mentioned, while the doors of the present invention molded of a RIM polymer over an aluminum frame weigh about 95 pounds. As there are sixteen doors per the hopper coal car above referred to, the doors of the present invention, which weigh about half as much as the aluminum doors, will reduce the weight of the car by over 1500 pounds. Trains carrying coal often have over 100 coal cars per train. Thus, the use of the doors of the present invention will allow over 150,000 additional pounds of coal per trip for a 100 car train.

In order to prevent any occurrence of hanging coal, a liner is placed over the side of the door engaging the coal to provide for a non-stick surface. One satisfactory material for use in the liner is a black UV resistant ultra-high molecular weight polyethylene (UHMWPE).

It is therefore a primary object of the present invention to provide a rapid discharge coal car door that will be lighter than an aluminum and steel door, thereby reducing the overall weight of a hopper coal car and allowing more coal to be transported per car and per a train of coal cars.

Another object of the invention is to provide a rapid discharge door for bottom dumping railcars carrying granular materials that will be lighter than an aluminum and steel door, thereby reducing the overall weight of the railcar and allowing more granular material to be transported.

Another object of the present invention is to provide a rapid discharge coal car door that provides adequate strength against load-bearing forces and which can withstand changes in the weather and the thawing process needed to thaw frozen coal.

A further object of the present invention is to provide a rapid discharge coal car door having a longer life than heretofore known doors and that will eliminate hanging coal heretofore encountered on steel and aluminum doors, thus allowing the coal car to fully discharge the coal.

Other objects, features and advantages of the invention will be apparent from the following detailed disclosure, taken in conjunction with the accompanying sheets of drawings, wherein like reference numerals refer to like parts.

DESCRIPTION OF THE DRAWING

FIGS. 1 to 5 illustrate in a hopper coal car according to the prior art the use of coal car discharge doors, wherein FIG. 1 is an elevational view of a hopper coal car on an overhead unloading trestle unloading the contents of the car;

FIG. 2 is an elevational and somewhat longitudinal sectional view taken through the coal car of FIG. 1 to further illustrate the mechanism for opening and closing the discharge doors;

FIG. 3 is a detailed schematic view of a part of the opening and closing mechanism for the discharge doors;

FIG. 4 is a bottom plan view taken substantially along line 4—4 of FIG. 2 showing the doors associated with the operating mechanism;

FIG. 5 is a top plan view of the hopper car of FIG. 2 taken substantially along line 5—5 of FIG. 2;

DESCRIPTION OF THE INVENTION

The railcar discharge door of the present invention is employed for opening and closing discharge openings of a hopper coal car to unload the contents. It will be appreciated that the discharge door of the invention may be used on any kind of hopper railcar having bottom discharge openings for transporting any type of granular material. More particularly, the discharge door of the invention will replace heretofore known all metal discharge doors in order to reduce the weight of the car so that its load capacity can be increased and also to provide a discharge door that may have a longer life than an all metal door. More particularly, the door of the invention is made of a polymer molded over an aluminum frame by a RIM process wherein the frame includes hinge members for hinging one edge of the door to the car and beam members for facilitating the inner connection of a pair of doors and connecting to an opening and closing device. Moreover, the door of the invention includes a liner of UV-resistant and abrasion-resistant plastic such as UHMWPE which also provides a non-stick surface to assure discharge of the coal or other granular material. It will be appreciated that the body of the door may be made of any suitable RIM polymer such as a Telene polymer made by B.F. Goodrich. Telene is a trademark of B.F. Goodrich. A Telene polymer is a light-weight thermoset polymer. The liner for the door may be made of any suitable UV- and abrasion-resistant plastic that also defines a non-sticking surface for the coal or other contents of the hopper car.

One form of door according to the invention is disclosed in this application and is principally for use on a hopper coal car of the well known type shown in FIGS. 1 to 5. As above mentioned, heretofore known doors are all metal and were made from a steel frame having an aluminum or steel pan secured to the frame.

Figure 5:
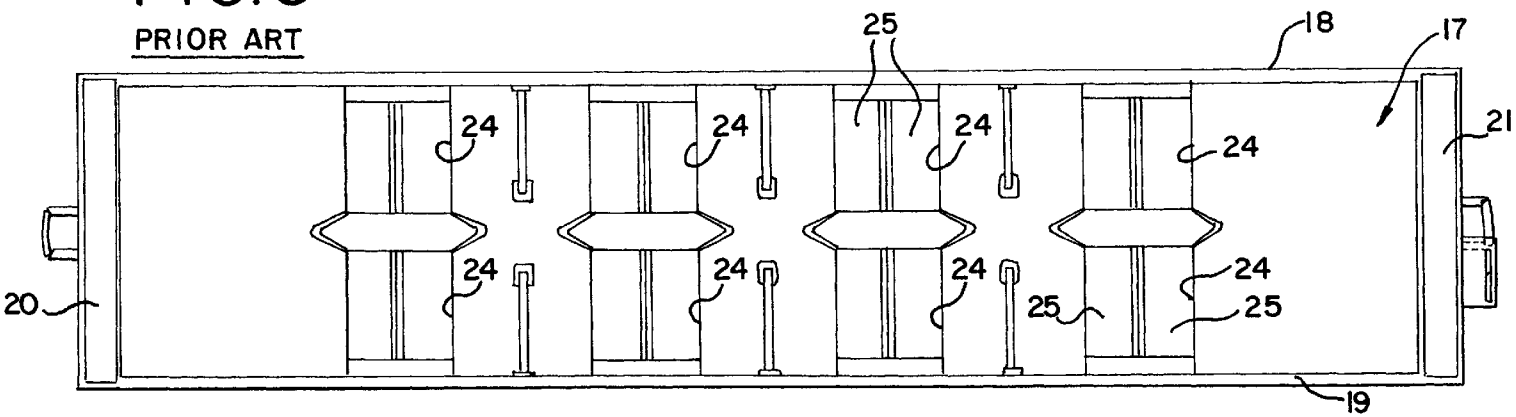
FIG. 5 PRIOR ART
Figure 6:
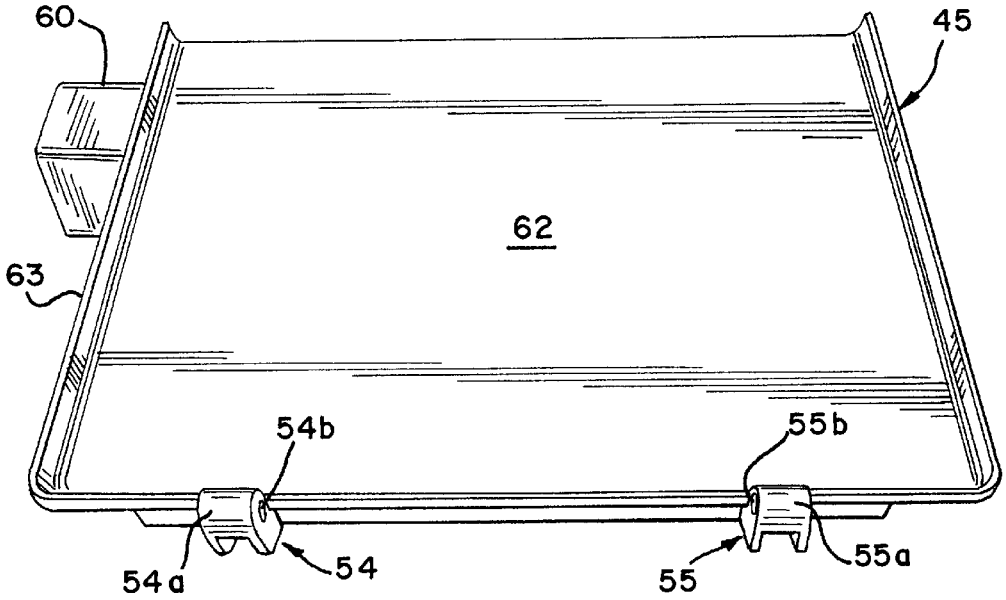
FIG. 6 is a perspective view of a discharge door according to the invention looking at the top side of the door.

The coal car discharge door of the present invention would be mountable on a hopper coal car, as shown in FIGS. 1 to 5, wherein the coal car is generally designated by the numeral 16 and includes end slope sheets or walls 17, upstanding side walls 18 and 19, and upstanding end walls 20 and 21 defining an open top compartment or hopper 22 (FIG. 2) for loading therein coal or any other suitable granular material. The car 10 includes a plurality of longitudinally spaced apart chutes 23 terminating in transversely spaced apart discharge openings 24 (FIG. 5). Each discharge opening is selectively opened for discharge of coal and thereafter closed by a pair of coacting doors 25 that are hinged to the bottom of the car at one end and opened and closed in clamshell fashion. A pair of transversely spaced apart doors 25 are interconnected together by a spine or beam 27 so that they move together during the opening and closing function. Each door 25 is hinged at its upper end by a suitable hinge 28 to the body of the car.

Any suitable mechanism may be used to open and close the doors and the mechanism illustrated is pneumatically driven and includes a double-acting pneumatic cylinder 31 mounted at one end of the car which when activated to open or close the doors drives a primary crank arm 32 pivotally mounted on the frame of the car which in turn is pivotally connected to a longitudinally extending drive rod 33 that extends substantially the entire length of the car and which in turn drives a plurality of secondary crank arms 35 pivotally mounted adjacent each set of doors. Each of the secondary crank arms 35 is in turn pivotally connected to one end of an actuating lever 36, the other end of which is pivotally connected to the spine or beam 27 of a set of side-by-side hung discharge doors. When the doors are in closed position, the linkage and crank arms go to an over-center position so that the doors cannot open except by operation of the pneumatic cylinder 31.

A suitable solenoid operated pneumatic valve 38 is connected between the brake pipe of the car and the pneumatic cylinder 31. At each side and end of the car a hot shoe 40 is provided for engagement with a contact member mounted adjacent to the track where unloading is to occur for receiving a signal to actuate the solenoid operated pneumatic valve 38 for driving the pneumatic cylinder for opening and closing the doors.

The discharge door of the present invention is shown in FIGS. 6 to 12 and generally designated by the numeral 45. This door includes an aluminum frame 47 and a polymer body 48 molded over the frame by the RIM process. It will be appreciated that the size and shape of the door may vary depending upon the discharge opening for which it is designed, although it would generally include the features described below and always include a main body molded over an aluminum frame.

Figure 10:
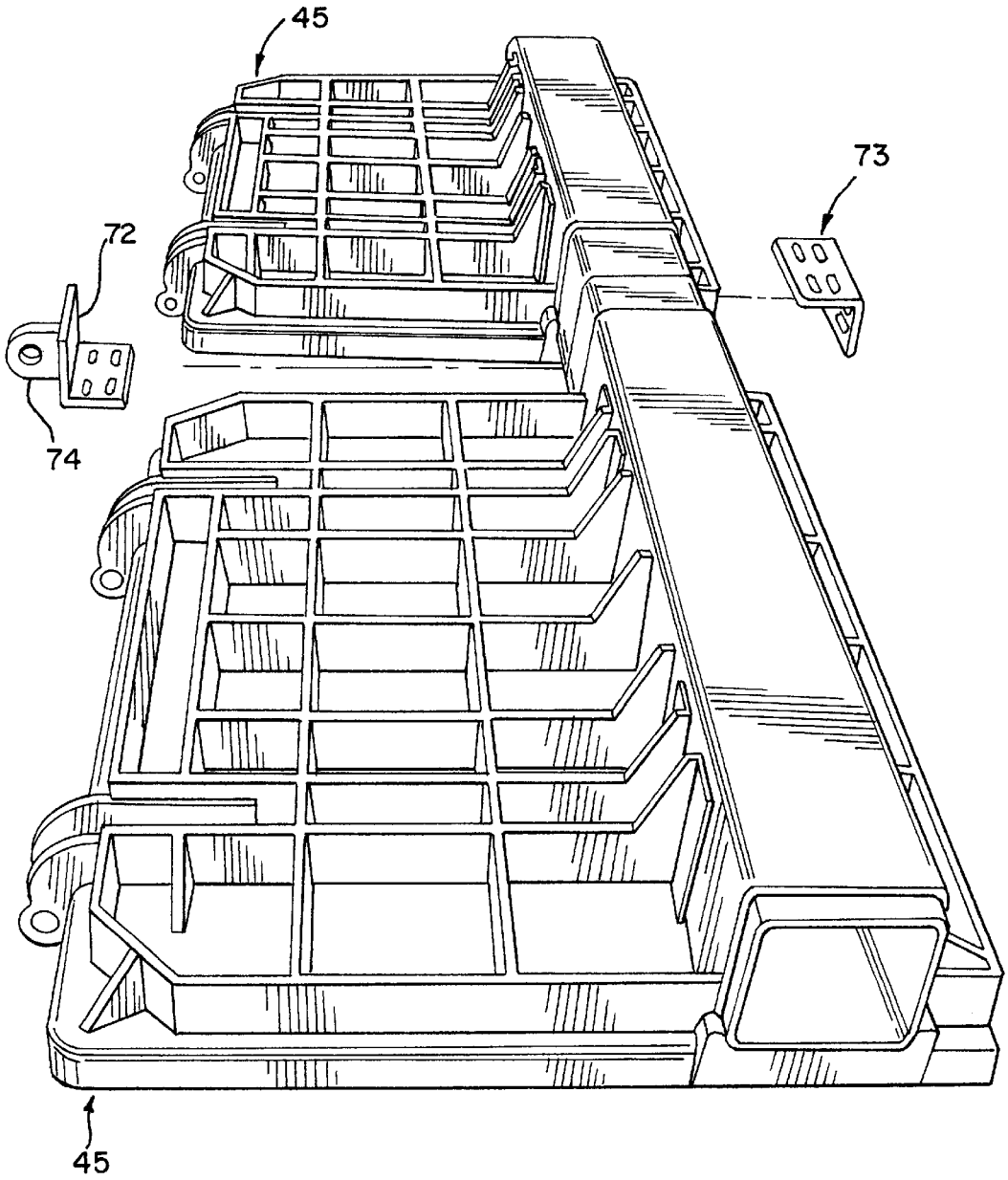
FIG. 10 is a perspective view of a pair of doors that are used side by side and interconnected together by a cross beam and looking at the underside of the doors and showing in exploded form the brackets for interconnecting the beams of adjacent doors.
Figure 11:
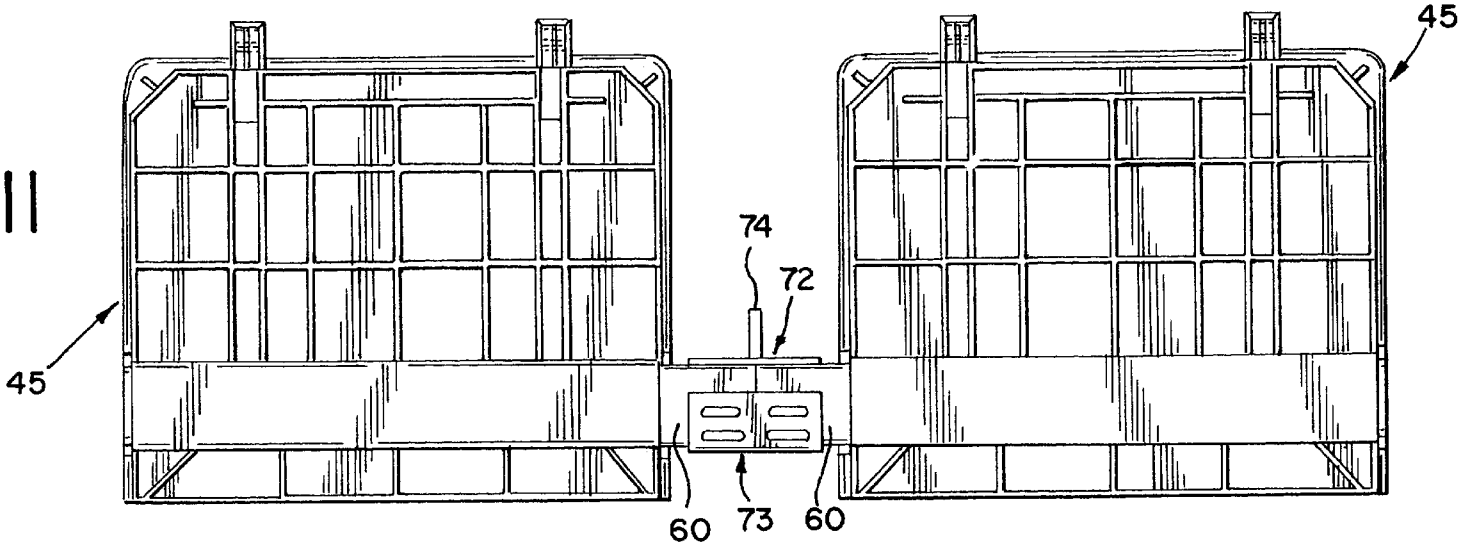
FIG. 11 is a plan view of the doors in FIG. 10 and connected together by the bracket.
Figure 12:
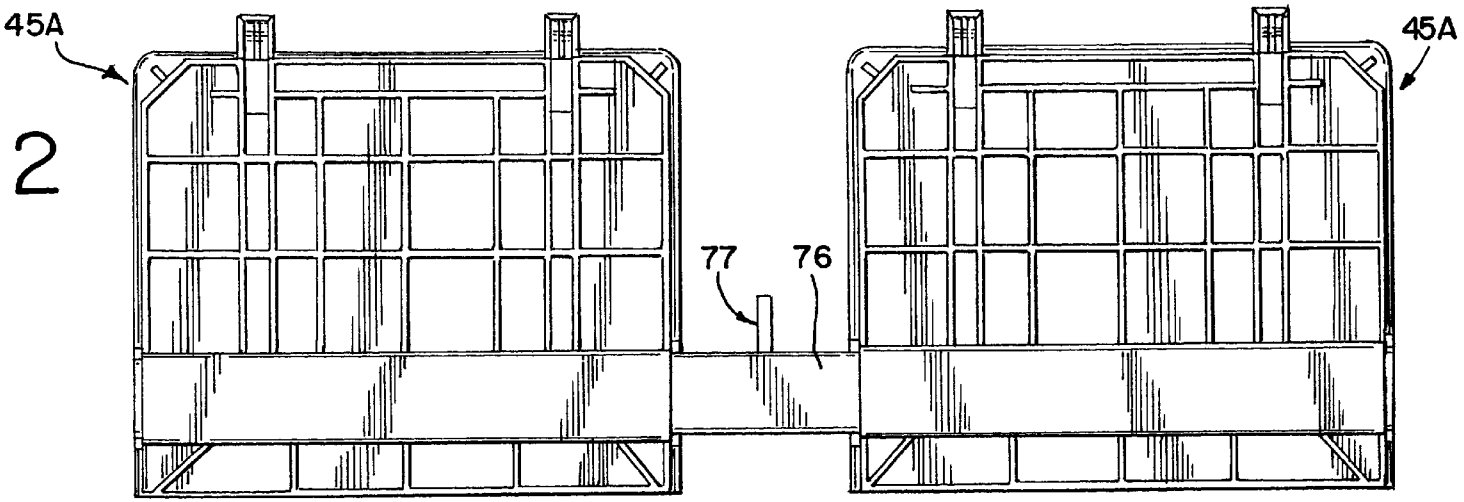
FIG. 12 is a view like FIG. 11 but a modification wherein a single beam is employed for interconnecting a set of doors.

The aluminum frame 47 not only provides a frame on which the polymer body is molded but also includes hinge elements and a beam or spine enabling the interconnection of a pair of doors where the invention is used to produce a set of doors, such as shown in FIGS. 10 to 12. The frame 47 in the embodiment shown in FIGS. 6 to 9 includes a pair of parallel spaced apart channel-shaped members 51 and 52, a crossbar 53 of channel shape extending between the upper ends of the vertically extending members 51 and 52, hinge members 54 and 55 at the upper ends of the vertical members 51 and 52, and a spine or beam 56 connected to the lower ends of the vertical members 51 and 52. While the vertical members 51 and 52 and the crossbar 53 are shown to be of a U-shaped channel configuration, it will be appreciated that they could take the form of T-shaped members or any other suitable shape. Similarly, while the beam 56 is box-shaped, it should be appreciated that it could likewise be of any other suitable cross-sectional shape. Further, the hinge members 54 and 55 include an offset head 54*a* and 55*a* with a transversely extending bore 54*b* and 55*b* for receiving a suitable shaft mounted on the coal car and which thereby makes the doors pivotally mounted to the bottom wall of the coal car.

It will be appreciated that during the molding of the main body of the door over the frame the hinge members 54 and 55 will not be covered with the polymer and likewise an extension 60 of the beam 56 will not be covered by the polymer so that interconnection with an extension of an adjacent door can be facilitated as will be further described below.

Figure 1:
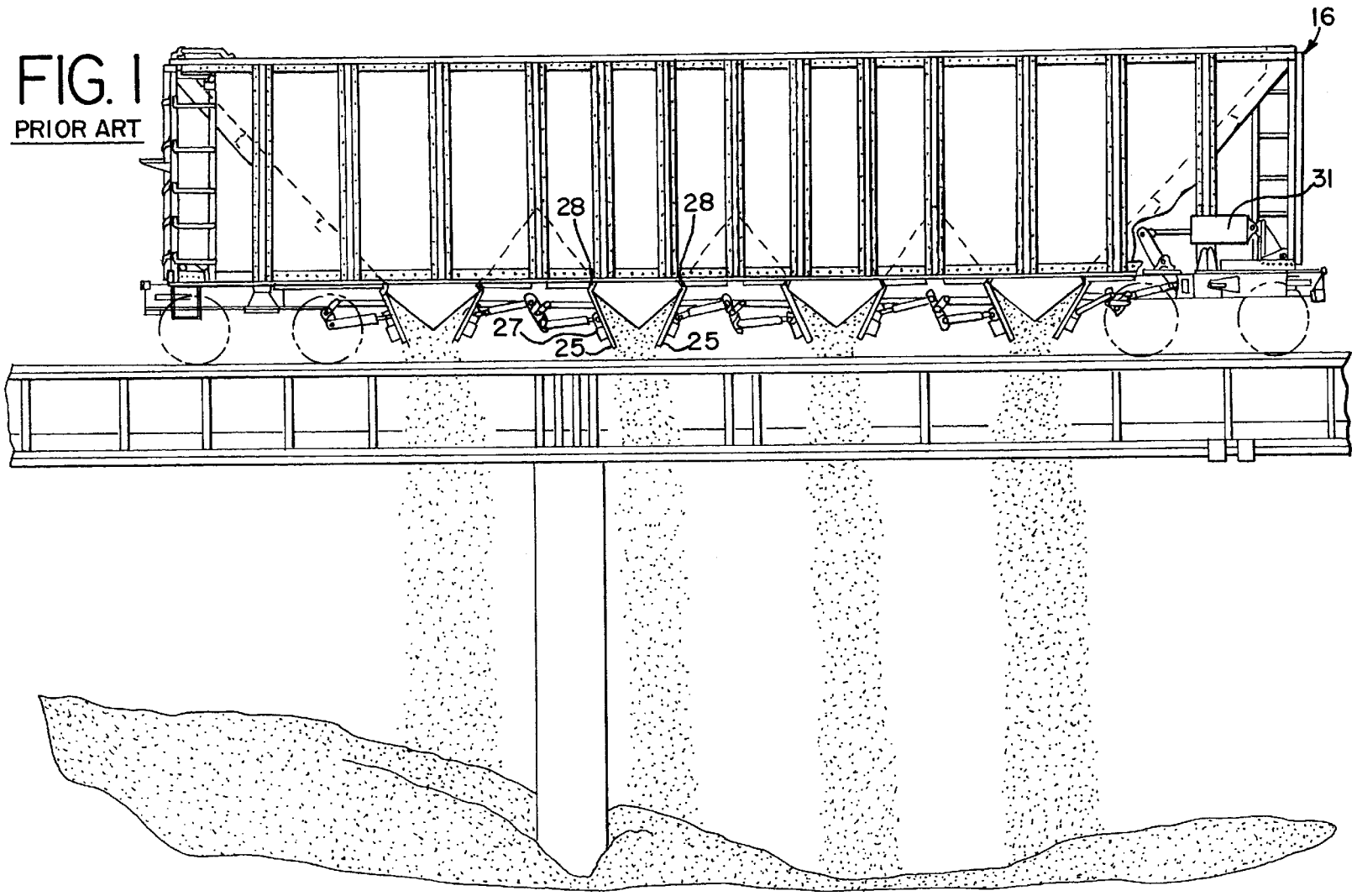
FIG. 1 PRIOR ART
Figure 2:
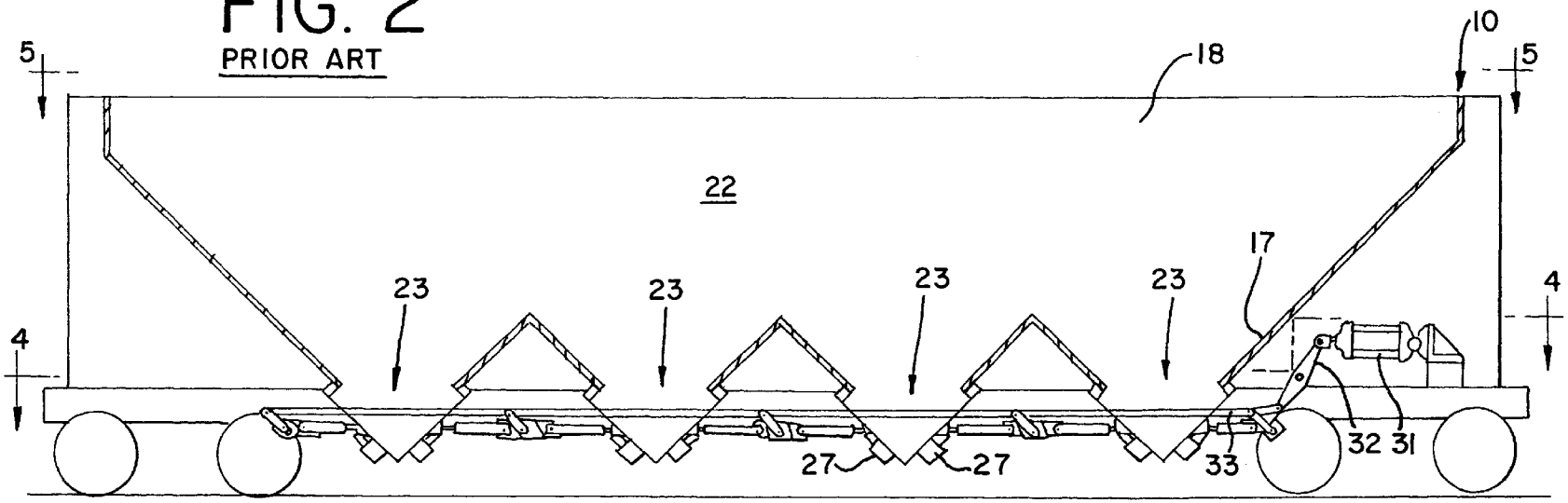
FIG. 2 PRIOR ART
Figure 3:
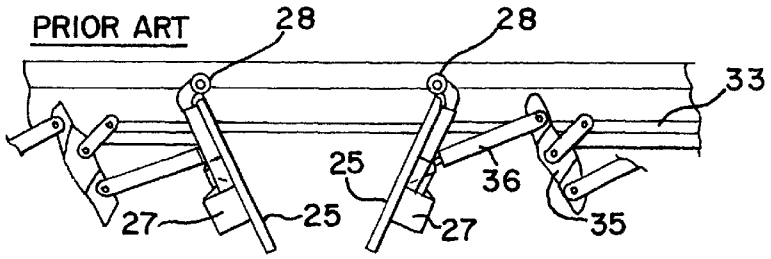
FIG. 3 PRIOR ART
Figure 4:
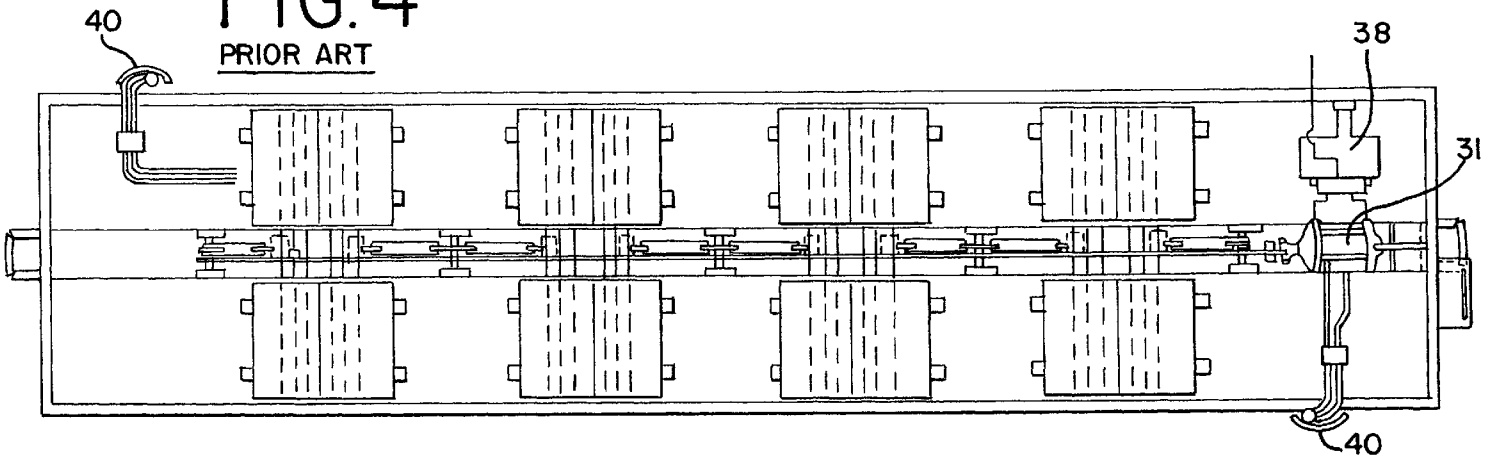
FIG. 4 PRIOR ART

The top side of the main body 45 of the door forms a planar surface 62 (FIG. 6) and a lip 63 is provided around three sides of the body for purposes of coacting with the discharge opening of the car to receive the edges of the discharge opening chute and prevent coal leakage. While the doors for the car illustrated are used in side-by-side or tandem fashion, each door will also coact with an opposing door, as shown in FIG. 1, for closing the discharge opening. The door 45 accordingly does not include a lip along the edge that will coact with an opposing door to close the discharge opening.

Figure 7:
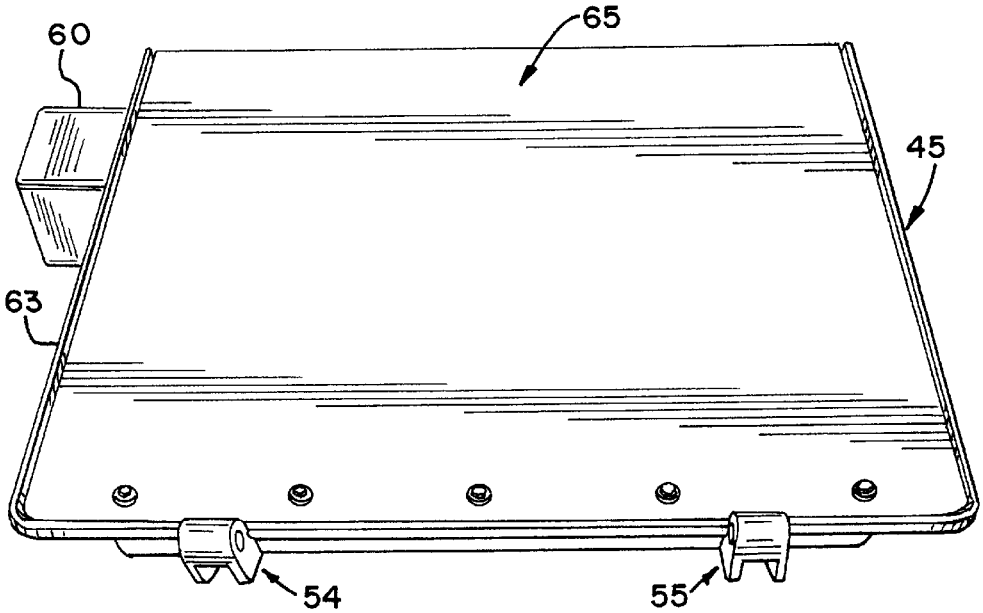
FIG. 7 is a view like FIG. 6 except that the door is provided with a liner according to the invention.

As seen in FIG. 7, a replaceable liner 65 is suitably secured over the planar surface 62 and within the lip 63. This liner is about one-eighth inch thick and is preferably made from UHMWPE of three-and-one-half to six million molecular weight to provide a non-stick surface against which the coal will bear during transit and freely slide over during discharge. As above noted, this material is abrasion-resistant and preferably black and UV-resistant since it will be subjected to the sun when the car is empty.

Figure 8:
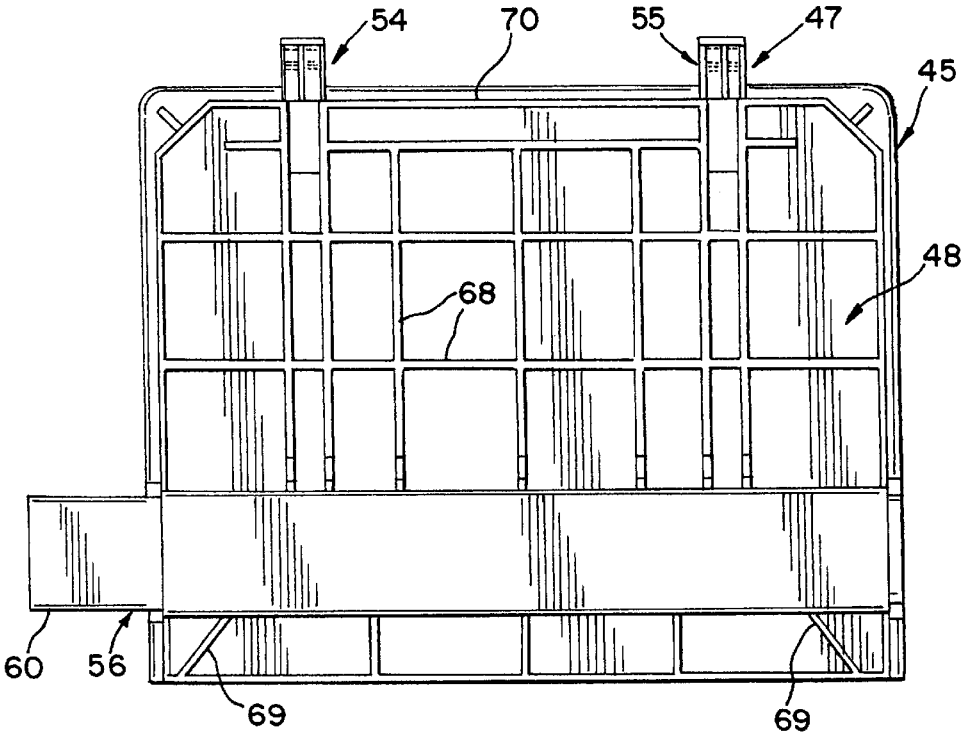
FIG. 8 is a bottom plan view of the door of FIG. 6.
Figure 9:
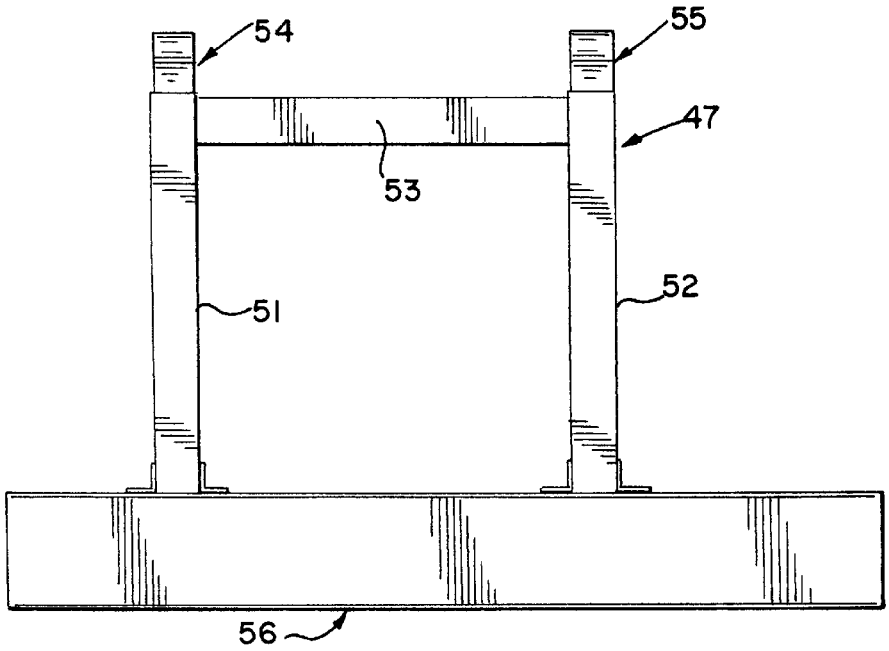
FIG. 9 is a plan view of the aluminum frame that is employed in the door of the invention and around which the polymer making up the body of the door is molded in the RIM process.

The underside of the door, as seen particularly in FIGS. 8 and 10, includes a plurality of interconnecting transversely extending and longitudinally extending reinforcing ribs 68 as well as angularly extending reinforcing ribs 69 and an outer perimeter reinforcing rib 70 which generally follows the outer contour of the main body. As is apparent, the reinforcing ribs not only interconnect between the vertically extending channel members of the frame but also the horizontally extending crossbar and the beam. These ribs enable the door to withstand the loading of the coal as well as the expansion and contraction endured during temperature changes.

Where the doors are used in tandem or side-by-side relation, a left-hand and a right-hand door are connected together in a suitable fashion. One manner of interconnecting the doors is shown in FIGS. 10 and 11, wherein the beam extensions 60 of adjacent doors are brought together in abutting and aligned relation, after which angle or L-shaped brackets 72 and 73 are placed upon the extensions at diagonally opposite comers and welded into place, as shown in FIG. 11. The angle bracket 72 includes an apertured lug 74 for pivotal connection to an actuating lever 36 of the operating mechanism.

Another form of connecting two adjacent doors together is illustrated in FIG. 12. These doors, designated 45A, are made slightly different in that the beam or spine does not include an extension wherein the opposite ends of the beam are substantially flush with the opposite sides of the polymer of the body door. While the beam in this embodiment is preferably box-shaped, it could be of any other suitable cross-sectional shape. Two adjacent doors in this embodiment would not then have to be made as left- and right-hand doors inasmuch as they would then be identical. The doors are interconnected by using a box-shaped connecting beam or spine 76 sized to be telescopically received within the beams of each of the adjacent doors 45A. The connecting beam 76 is suitably connected to the beams of the doors by welding, huck-bolting or other means which then thereby interconnects the doors as a pair or set. Thereafter, an apertured lug 77 is suitably mounted on the connecting beam 76 such as by welding or otherwise and which serves to be connected to the actuating lever of the operating mechanism. It will be appreciated that the connecting beam and lug may be cast as a one-piece unit. Alternatively, a frame having two sets of vertical and horizontal bars could be secured to a single elongated beam, where the polymer body for each set could be molded at the same time, or one body could be molded at a time. Thereafter, a lug could be secured to the beam at a location between the doors.

As above mentioned, while the doors illustrated are designed for the hopper coal cars of the prior art shown in FIGS. 1 to 5, they could be designed for hopper coal cars where the discharge opening or chute would merely require a single door and which could be latched in closed position and suitably unlatched to gravitationally open for discharge of the coal. Moreover, the aluminum frame and RIM process polymer door of the present invention could be used on coal cars having longitudinally extending doors wherein it will be appreciated that the frame would have additional vertical bars between the crossbar near the hinges and the beam.

It will be understood that modifications and variations may be effected without departing from the scope of the novel concepts of the present invention, but it is understood that this application is to be limited only by the scope of the appended claims.

The invention is hereby claimed as follows:

1. A discharge door for selectively opening and closing a discharge opening in a railcar comprising:

an aluminum frame having hinge means at one end and an actuating beam at the other end, and a main body of polymer molded over the frame by a RIM process to define a generally planar surface on the top side facing the interior of the car to close the opening and a ribbed surface on the bottom side to further reinforce the body.

2. The discharge door of claim 1, wherein the polymer is a lightweight thermoset material.

3. The discharge door of claim 1, wherein the hinge means includes spaced apart hinge members not covered by the polymer.

4. The discharge door of claim 1, wherein the actuating beam is tubular.

5. The discharge door of claim 4, wherein the tubular beam is box-shaped.

6. The discharge door of claim 4, wherein the tubular beam is box-shaped and extends from one side of the main body for interconnection with another door to operate as a set for a pair of side-by-side openings.

7. The discharge door of claim 1, wherein a lip is formed peripherally to coact with the discharge opening to close same against leakage of coal.

8. The discharge door of claim 1, which further includes a liner on the planar surface of an abrasion-resistant material.

9. The discharge door of claim 8, wherein the liner is of a UV resistant UHMWPE.

10. The discharge door of claim 9, wherein the UHMWPE is abrasion-resistant with a non-sticking surface.

11. In a hopper coal car having a bottom with a plurality of discharge openings, a plurality of discharge doors for selectively opening and closing said openings, the improvement in said doors wherein each door comprises an aluminum frame having hinge means at one end and an actuating beam at the other end, and a main body of polymer molded over the frame by a RIM process to define a generally planar surface on the top side facing the interior of the car to close the opening and a ribbed surface on the bottom side to further reinforce the body.

12. The combination of claim 11, wherein the polymer is a lightweight thermoset material.

13. The combination of claim 11, wherein the actuation beam is tubular.

14. The combination of claim 11, wherein the actuation beam is box-shaped.

15. The combination of claim 11, which further includes a liner mounted on the planar surface of the door.

16. The combination of claim 15, wherein the liner has a non-stick surface facing the interior of the car.

17. The combination of claim 16, wherein the liner is of a UV-resistant UHMWPE.

18. The combination of claim 11, wherein the discharge openings and doors extend transversely of the car.

19. The combination of claim 11, wherein the discharge openings and doors extend longitudinally of the car.

20. In a hopper coal car having a bottom with a plurality of discharge openings, a plurality of discharge doors for selectively opening and closing said openings, the improvement in said doors wherein each door comprises an aluminum frame having hinge means at one end and an actuating beam at the other end, and a main body of polymer molded over the frame to define a generally planar surface on the top side facing the interior of the car to close the opening and a ribbed surface on the bottom side to further reinforce the body.

21. In a hopper coal car having a bottom with a plurality of discharge openings, a plurality of discharge doors for selectively opening and closing said openings, said discharge openings and doors extending transversely of the car, the improvement in said doors wherein each door comprises:

an aluminum frame having hinge means at one end and an actuating beam at the other end, and a main body of polymer molded over the frame by a RIM process to define a generally planar surface on the top side facing the interior of the car to close the opening and a ribbed surface on the bottom side to further reinforce the body, wherein the beam includes an extension at one side of the main body, and connecting means interconnecting the beam extensions of a pair of doors in side-by-side relation as a set for a pair of transversely spaced apart discharge openings.

22. The combination of claim 21, wherein the connecting means includes a bracket attached to the beam extensions.

23. In a hopper coal car having a bottom with a plurality of discharge openings, a plurality of discharge doors for selectively opening and closing said openings, said discharge openings and doors extending transversely of the car, the improvement in said doors wherein each door comprises:

an aluminum frame having hinge means at one end and an actuating beam at the other end, and a main body of polymer molded over the frame by a RIM process to define a generally planar surface on the top side facing the interior of the car to close the opening and a ribbed surface on the bottom side to further reinforce the body, wherein the ends of the beams for each door are substantially flush with the sides of the main body, and connecting means interconnecting a pair of doors in side-by-side relation as a set for a pair of transversely spaced apart discharge openings.

24. The combination of claim 23, wherein the connecting means includes a spine received in and attached to said beams.

* * * * *